US005419305A

United States Patent [19]

Hanley

[11] Patent Number: 5,419,305

[45] Date of Patent: May 30, 1995

[54] AUTOMATIC BIMETAL SAFETY LATCH FOR SELF-CLEANING OVEN DOORS

[76] Inventor: Roger T. Hanley, 605 Jones Ferry Rd., Carroboro, N.C. 27510

[21] Appl. No.: 116,013

[22] Filed: Sep. 2, 1993

[51] Int. Cl.[6] ..... F24C 15/04

[52] U.S. Cl. ..... 126/197; 126/273 R; 292/DIG. 69; 292/DIG. 66; 292/113

[58] Field of Search ..... 126/197, 273; 292/113, 292/DIG. 69, DIG. 66, 105, 108

[56] References Cited

U.S. PATENT DOCUMENTS

| | | | |
|---|---|---|---|
| 3,406,677 | 10/1968 | Anderson . | |
| 3,416,515 | 12/1968 | Mertler . | |
| 3,438,666 | 4/1969 | Erickson . | |
| 3,540,767 | 11/1970 | Siegel . | |
| 3,638,638 | 2/1972 | Phifer . | |
| 4,133,337 | 1/1979 | Shea . | |
| 4,136,667 | 1/1979 | Lewis . | |
| 4,163,443 | 8/1979 | Peterson . | |
| 4,364,589 | 5/1982 | Watson . | |
| 4,663,505 | 5/1987 | Drake | 219/10.55 C |
| 4,862,870 | 9/1989 | Fox . | |
| 5,220,153 | 6/1993 | Malone et al. | 126/197 |

FOREIGN PATENT DOCUMENTS

| | | | |
|---|---|---|---|
| 2325506 | 12/1973 | Germany | 126/197 |

*Primary Examiner*—Larry Iones

[57] ABSTRACT

An oven safety door latch has a pair of elongated latch arms pivotably connected to each other and to a base at a point intermediate their length. The arms project beyond the base and have end portions with opposed latching noses. A pawl is rotatably mounted on the base adjacent an end of the arms and has a blocking element engageable with the arms. A spring biases the latch arms and thereby the noses towards each other, and a stop element limits this movement of the noses towards each other. A thermally responsive element is operatively connected to the pawl to rotate it between a first position in which the blocking element is spaced from the arms, and a second position in which the blocking element is engaged with the end portions of the arms to limit their movement and thereby the movement of the noses away from each other to maintain the latch in engagement with the oven door.

17 Claims, 5 Drawing Sheets

8
14
16
18
22
24
28
30
46
48
50
52
54
56
70
72
74
76
78
80
82
84
88
92
94
96
98
100
102
108
122
123

AUTOMATIC BIMETAL SAFETY LATCH FOR SELF-CLEANING OVEN DOORS

BACKGROUND OF THE INVENTION

The present invention relates to door latches for ovens and, more particularly, to automatic safety latches for self-cleaning ovens.

Many ovens today have a self-cleaning feature allowing for the complete combustion of organic deposits on the inner walls of the oven by utilizing temperatures well above the normal range for cooking.

The use of these high temperatures has made it essential to maintain the oven door latch in a locked condition when the temperature is above a preset value. Use of automatic locking mechanisms protects the user by preventing accidental or inadvertent opening of the oven door while the temperature is very high.

In some prior art devices, an external handle is provided on the oven and is movable to lock the door in a latched condition. A separate locking mechanism associated with the latching mechanism is desirably employed to prevent operation of the handle. The locking means employed in the prior art is usually a rotary thermal locking member driven by a bimetallic coil, which, upon thermal expansion, causes rotary motion of the locking member which acts to prevent operation of the handle to open the oven door.

Several drawbacks exist with this type of locking assembly. The handle presents an extra manipulation, and in some embodiments using a bimetallic coil, the locking mechanism does not act directly upon the latching element. Other prior art devices utilize a number of interconnected links and locking members, which increase cost and require more complex mechanisms.

It is an object of the present invention to provide a novel oven safety door latch which is automatic and simple in operation.

It is also an object to provide such an oven safety door latch in which the latch arms provide a positive lock for the door through a simple mechanical action.

Another object is to provide such an oven safety door latch in which there are relatively few movable parts, which may be fabricated readily and relatively economically and readily assembled to provide reliability in operation.

SUMMARY OF THE INVENTION

It has now been found that the foregoing and related objects may be readily attained in an oven safety door latch for use with an oven door having a pair of horizontally spaced openings on its inner face. The latch has a base and a pair of elongated latch arms pivotably connected to each other and to the base at a point intermediate their length. One end of the arms projects beyond the base, and the arms have opposed latching noses on the end portions at this end.

A pawl is rotatably mounted on the base adjacent the other end of the arms, and it has blocking means thereon engageable with the end portions at the other end of the arms. Biasing means biases the one end of the latch arms and thereby the noses towards each other, and limiting means on the base limits movement of the noses towards each other. A thermally responsive element is supported by the base and operatively connected to the pawl to rotate the pawl between a first position in which the blocking means is spaced from the arms, and a second position in which the blocking means is engaged with the end portions of the arms to limit movement thereof and thereby to limit movement of the noses away from each other.

Closing movement of the oven door allows the noses to be cammed apart by the inner face of the door and to pass through its horizontally spaced openings. The biasing means thereafter biases the noses towards each other to lock behind the inner face of the door adjacent the openings therein. Subsequent heating of the thermally responsive element above a preset temperature causes the pawl to rotate from the first position to the second position to block movement of the arms and camming apart of the noses by movement of the door in an opening direction. Subsequent cooling of the thermally responsive element below a preset temperature causes the pawl to rotate from the second position to the first position to allow movement of the arms and the camming apart of the noses upon opening movement of the oven door.

Desirably, the blocking means on the pawl is a tab interposable between the end portions at the other end of the arms to limit movement thereof towards each other and thereby to limit movement of the noses away from each other.

Preferably, the biasing means also biases the end portions at the other end of the arms away from each other as it biases the one end of the latch arms and thereby the noses towards each other. The biasing means is usually a tension spring having its ends engaged with the latch arms intermediate the latching noses and the point of pivotable connection. The limiting means is a stop element on the base disposed between the pivot point and the end portions at the one end of the arms.

In the preferred embodiment, the base seats a pivot pin at the point of pivotal connection, and each of the arms has an aperture pivotally seating the pin. The arms have overlying horizontally disposed ears and the apertures are disposed therein.

The latch includes temperature setting elements adjustably mounted on the base and the preset temperatures are set by the temperature setting elements engaging the pawl to limit its rotation. The thermally responsive element is a bimetallic coil.

DETAILED DESCRIPTION OF THE PREFERRED EMBODIMENT

Figure 1:
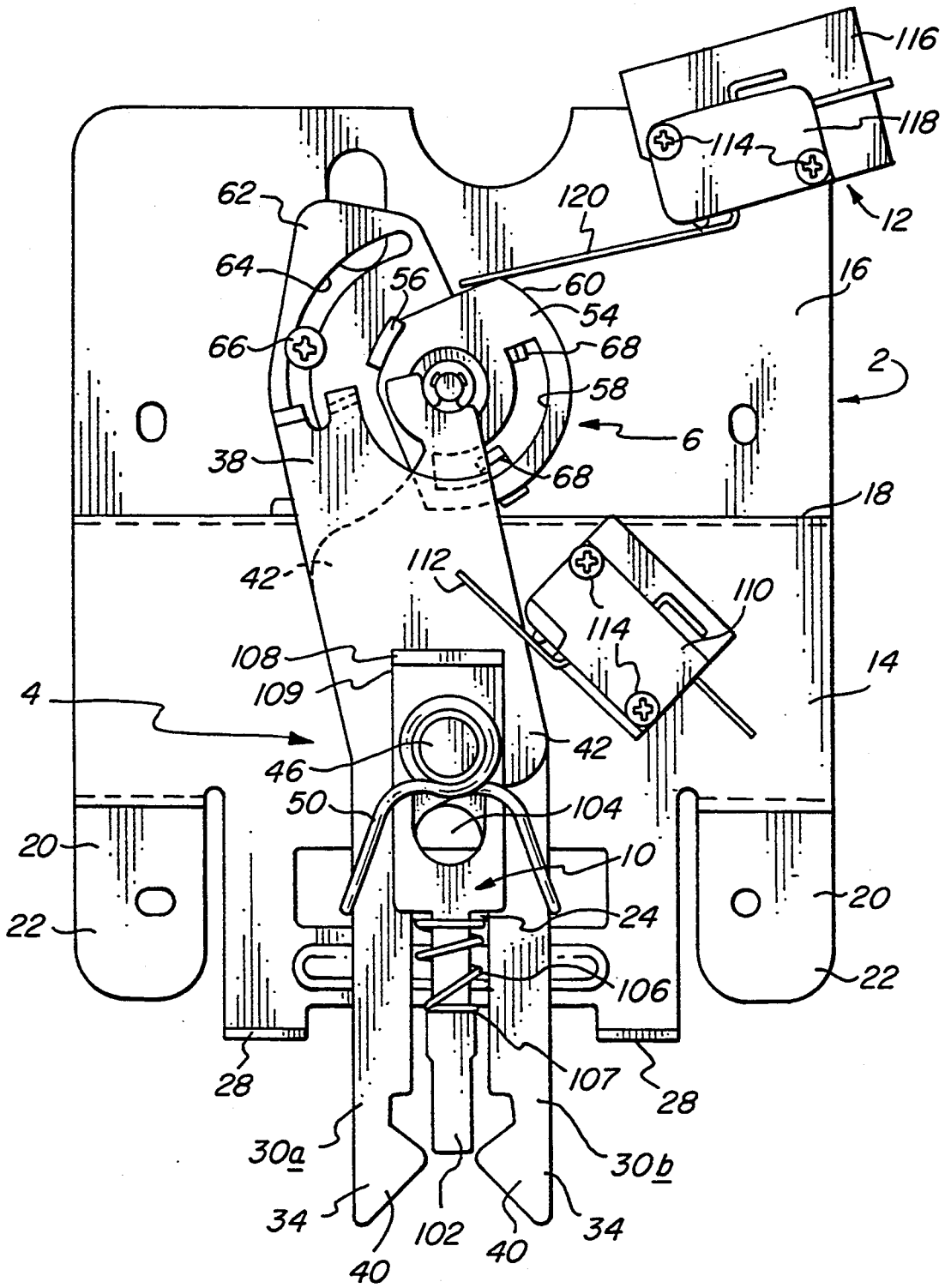
FIG. 1 is a top plan view of an oven safety door latch embodying the present invention.

Turning first to FIGS. 1–4, therein illustrated is an oven safety door latch embodying the present invention with a base or support generally designated by the numeral 2, a latch assembly generally designated by the numeral 4, a pawl assembly generally designated by the numeral 6, a thermally responsive drive assembly generally designated by the numeral 8, a closed door sensor assembly generally designated by the numeral 10, and a locked latch sensor assembly generally designated by the numeral 12.

The base 2 is formed with an upper horizontal portion 14 at its forward end and a lower parallel portion 16 at the rearward end joined by a vertical wall 18. The upper portion 14 supports the latch assembly 4 and the closed door sensor assembly 10. The lower portion 16 supports the pawl assembly 6, the thermally responsive drive assembly 8, and the locked latch sensor assembly 12. Edge portions 20 of the upper portion 14 are bent downwardly and forwardly to form base legs 22. Portions of the front end of the upper portion 14 are turned upward at right angles to form mounting tabs 28.

The latch assembly 4 has elongated latch arms or bolts 30 pivotably mounted to each other and to the base 2. The latch arms 30 have end portions 34 at their front end and end portions 38 at their rear end. The end portions 34 of the latch arms 30 are configured to provide opposing latching noses 40, and the latch arms 30 have horizontally disposed ears 42 with aligned apertures therein (not shown). The ear 42 of the latch arm 30*a* is offset upwardly to overlay the ear 42 of the latch arm 30*b*.

The aligned apertures (not shown) seat the pivot pin or rivet 46 which is secured to the upper portion 14 of the base 2. Also mounted on the pivot pin 46 below the latch arms 30, is a bushing 48. A bifurcated stop element 24 on the base 2 extends upwardly between the latch arms 30 and between the pivot pin 46 and the end portions 34 of the latch arms 30 and limits the movement of the noses 40 towards each other.

A tension spring 50 is also mounted on the pivot pin 46 above the latch arms 30 and has downwardly extending end portions 52 engaged with the latch arms 30 to bias the noses 40 towards a closed position.

Turning now in detail to the pawl assembly 6, a pawl 54 has an upstanding locking tab 56 and, adjacent its periphery, an arcuate slot 58. The periphery of the pawl 54 provides a cam surface 60. The pawl 54 is mounted to extend parallel to and spaced from the lower portion 16 of the base 2, and it is supported on the thermally responsive drive assembly 8.

The pawl assembly 6 also includes a temperature setting element or lock stop 62 with an arcuate slot 64 which provides an adjustable orientation of the lock stop 62 on the lower portion 16 by a lock stop screw 66 slidably positioned within the slot 64. At lease a portion of the lock stop 62 is positioned between the pawl 54 and the lower portion 16, and a pair of tabs 68 extend upwardly from the lock stop 62 into the arcuate slot 58 of the pawl 54.

The thermally responsive drive assembly 8 includes a thermally responsive element or bimetallic coil 70 spaced below and parallel to the lower portion 16. A housing 72, open at its bottom, encloses the bimetallic coil 70, and one end 74 of the bimetallic coil 70 is attached to the bracket 80. The other end 76 of the bimetallic coil 70 is attached to the shaft 78.

The bracket 80 has an upper horizontal portion 82 affixed to the lower surface of the lower portion 16 of the base 2. An intermediate horizontal portion 84 of the thermal bracket 80 is enclosed within the housing 72 and spaced horizontally above the bimetallic coil 70. A lower horizontal portion 88 is secured in heat transfer contact with the top wall of the oven (not shown).

The intermediate horizontal portion 84 and the upper horizontal portion 82 have aligned apertures therein (not shown) through which the shaft 78 extends in a vertical orientation. A thermal lip 92 encloses the portion of the shaft 78 which extends between the upper horizontal portion 82 and the intermediate horizontal portion 84 of the thermal bracket 80. The shaft 78 passes upward through an aperture (not shown) in the lower portion 16 of the base 2, and thence through an aperture (not shown) in the lock stop 62. Mounted on the shaft 78 above the lock stop 62 are a pawl washer 94 and the pawl 54. Mounted on the shaft 78 above the pawl 54 are the torque spring 96, clutch washer 98, and retaining ring 100 which effect rotation of the pawl 54 when the shaft 78 rotates.

Turning now in detail to the closed door sensor assembly 10, a sensing plunger 102 is mounted on the pivot pin 46 above and parallel to the latch arms 30. The sensing pin 102 has a slot 104 which slidingly receives the pivot pin 46, and it passes through a channel (not shown) in the stop element 24 and has an upturned tab 108 at its back end 109. Mounted on the sensing plunger 102 between the stop element 24 and a shoulder 107 on the sensing plunger 102 is a compression spring 106.

A microswitch 110 having a switch arm 112 is mounted on the upper portion 14 of the base 2 by the screws 114, and it is positioned so that switch arm 112 is adjacent the upturned tab 108 of the sensing plunger 102 so that it is actuatable thereby.

The locked latch sensor assembly 12 has an insulator 116 mounted on the lower portion 16 of the base 2, and a second microswitch 118 is mounted by the screws 114 on the insulator 116 and has an arm 120 positioned adjacent the cam surface 60 of the pawl 54.

Figures 2, 3, 4:
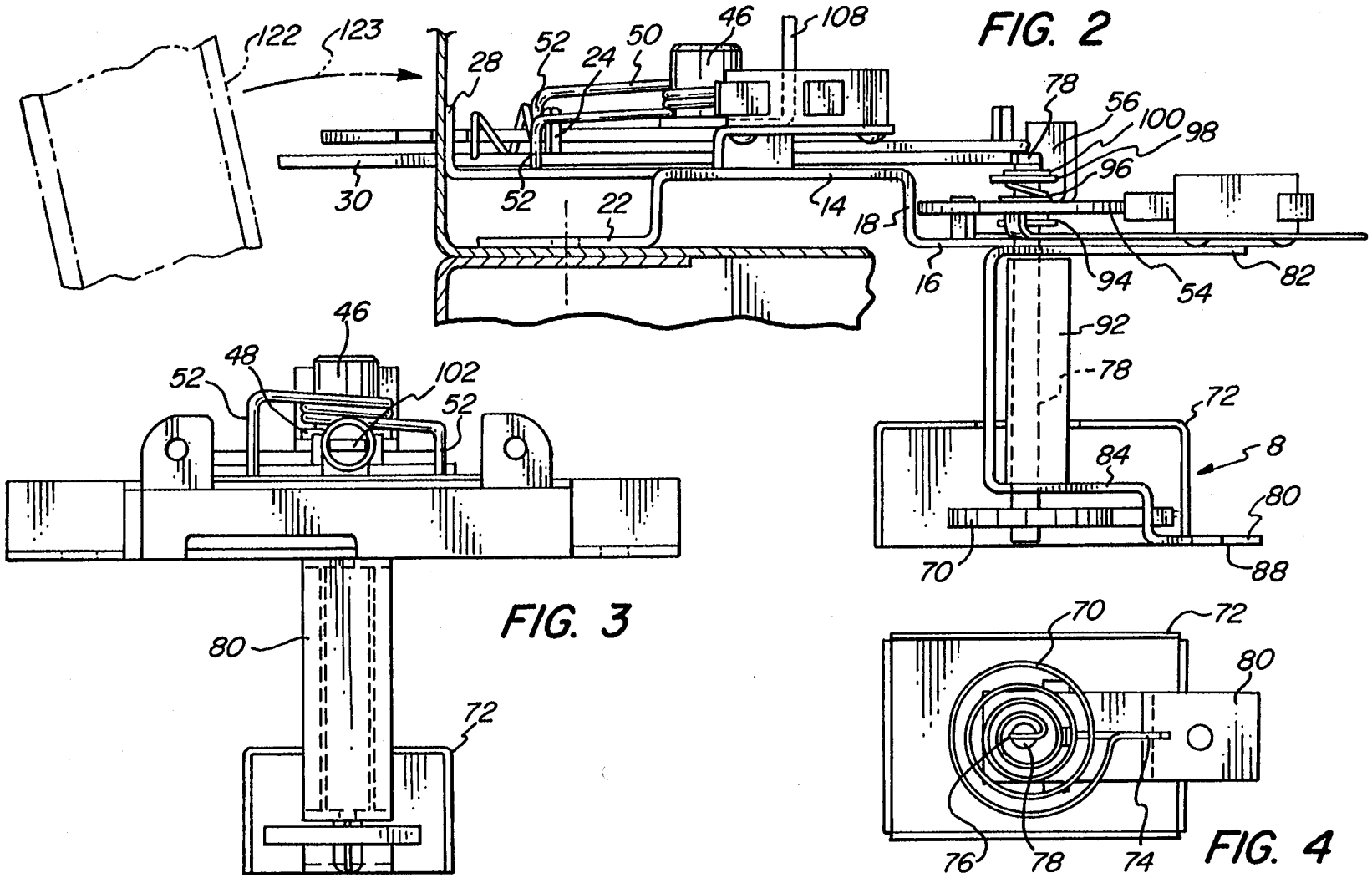
FIG. 2 is a side elevational view of the oven safety door latch of FIG. 1 with the oven walls shown fragmentarily in cross section, the oven door shown fragmentarily in phantom line and the arrow indicating the direction of closing movement of the oven door.
FIG. 3 is a front elevational view of the oven safety door latch of FIG. 1.
FIG. 4 is a bottom plan view of the bimetallic coil, housing, bracket and shaft in the oven safety door latch of FIG. 1.
Figure 5:
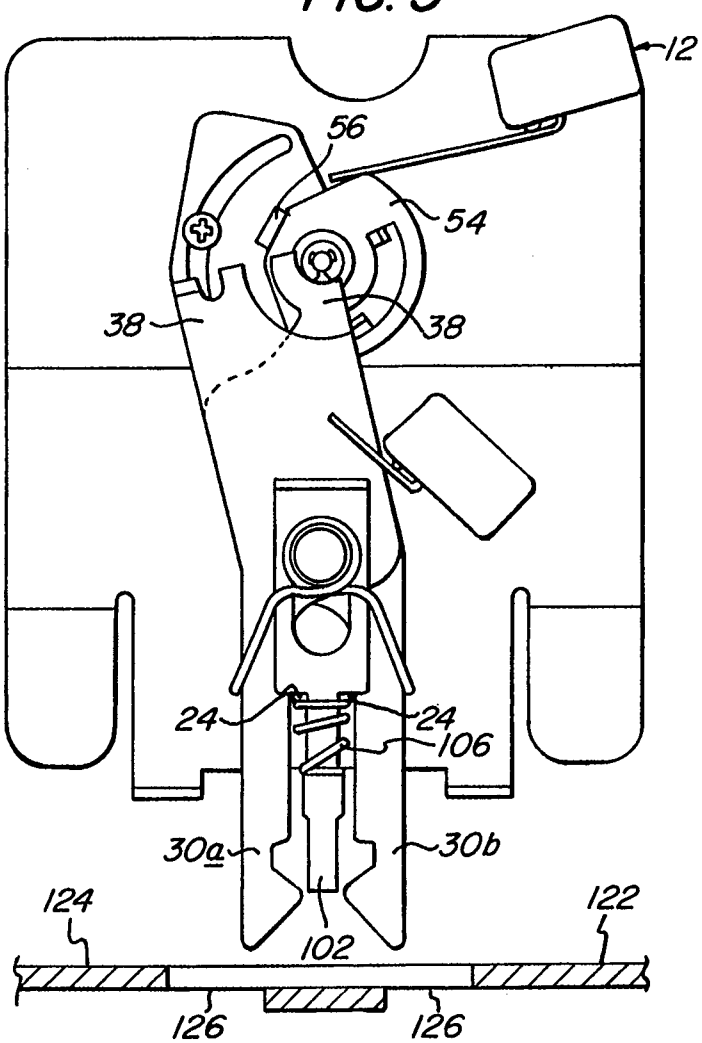
FIG. 5 is a top plan view of the oven safety door latch of FIG. 1 and of the inner face of a fragmentarily illustrated oven door, with the door in a partially open position.

Referring now to FIGS. 2 and 5, the oven safety door latch of the present invention is mounted within the stove so that the latching noses 40 project therefrom towards the oven door 122. The inner face 124 of the oven door 122 provides two horizontally spaced openings 126 through which the latching noses will extend in the closed position of the door 122, and the arrow 123 shows the direction of the closing movement of the oven door 122.

The use of the oven safety door latch embodying the principles of the present invention will be readily apparent. The base 2 of the oven safety door latch is mounted on a wall of the stove by fasteners (not shown) extending through the base legs 22, the lower portion 16 of the base 2, and the mounting tabs 28. The lower horizontal portion 88 of the bracket 80 may be similarly secured to the oven wall by fasteners. The bimetallic coil 70 is positioned adjacent to the oven wall.

Referring now to FIGS. 5–10, the operation of the oven safety door latch in cooperation with the oven door 122 is illustrated. In FIG. 5, the oven door 122 is in an open position and the latch arms 30 are being biased towards a closed position against the stop element 24 by the spring 50. The tab 56 of the pawl 54 is spaced from the rear end portions 38 of the latch arms 30. The thermally responsive drive assembly 8 has not been actuated to rotate the pawl 54 from its at rest position, and the sensing plunger 102 of the closed door sensor assembly 10 is biased towards the oven door 122 by the spring 106. The locked latch sensor assembly 12 is not actuated.

Figure 6:
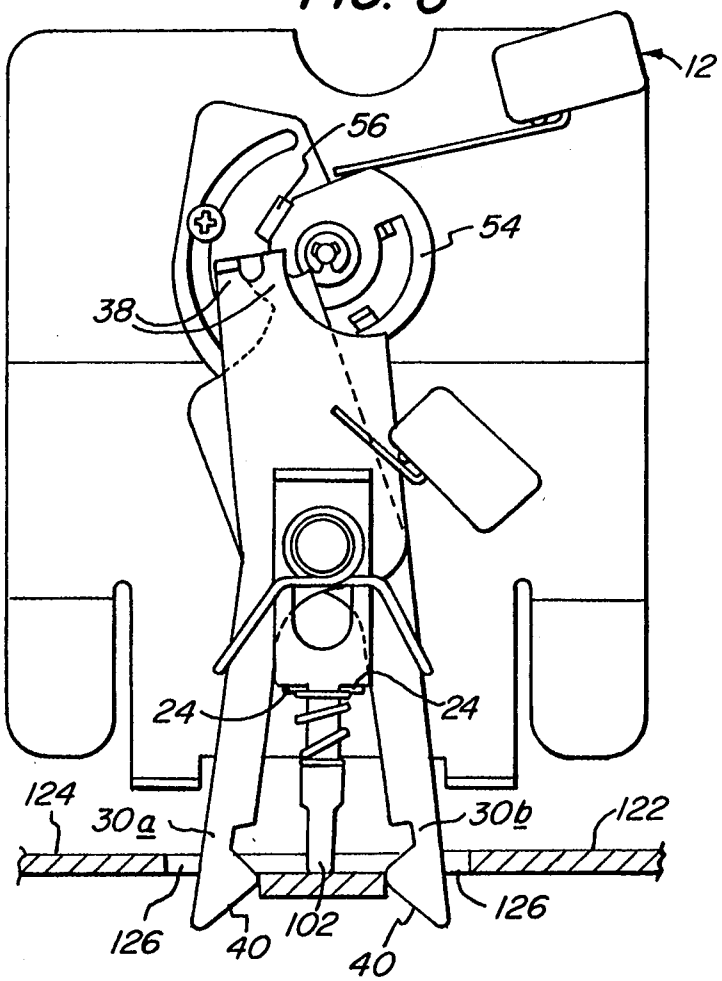
FIG. 6 is a similar view showing the oven door camming apart the latch arms.

Referring now to FIG. 6, the oven door 122 has been moved to a nearly closed position. The latching noses 40 of the latch arm 30 have been cammed apart by the inner face 124 of the oven door 122 and are moving through the horizontally spaced openings 126 of the inner face 124. The door sensing plunger 102 is in contact with the oven door 122 but it is not displaced from its forwardly biased position.

Figure 7:
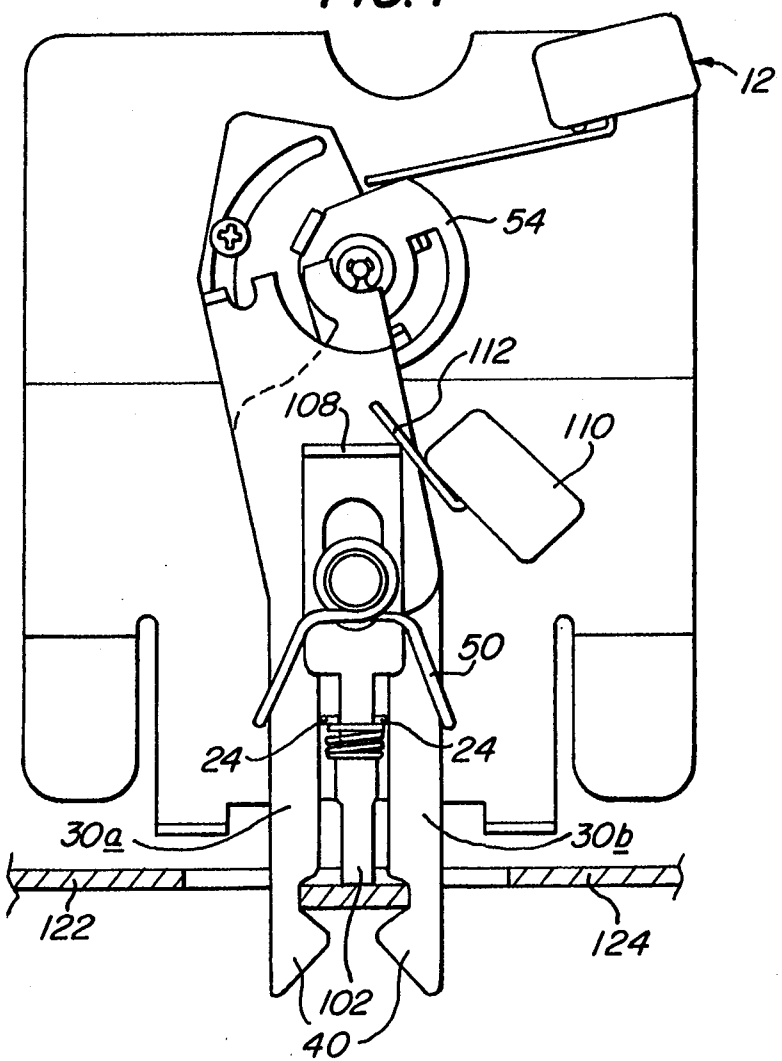
FIG. 7 is a similar view with the latch arms engaged with the inner face of the oven door, but before operation of the thermal locking mechanism.

Referring next to FIG. 7, the oven door 122 has been moved to its closed position, and the latching noses 40 of the latch arms 30 are lockingly engaged behind the inner face 124 of the oven door 122. The latching noses 40 have been biased towards this closed position by the spring 50. The sensing plunger 102 has been moved rearwardly, causing the upturned tab 108 to bear against the switch arm 112, thereby activating the microswitch 110. This microswitch 110 can be used to enable the energizing of the oven heating coils (not shown), a door closed indicator light (not shown), etc.

Figure 8:
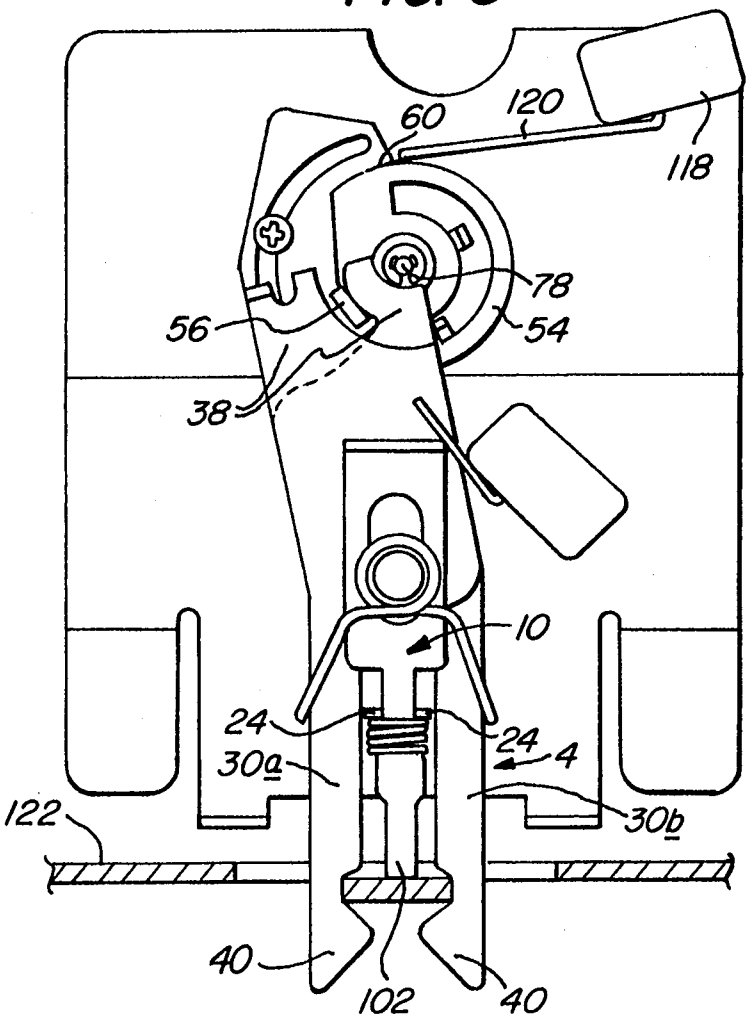
FIG. 8 is a similar view after operation of the thermal locking mechanism to move the locking tab into a blocking position between the latch arms.

Referring now to FIG. 8, the oven door 122 and latch assembly 4 are in the same position as in FIG. 7. However, heating of the oven above a preset temperature has caused the bimetallic coil 70 to rotate the shaft 78, thereby rotating the pawl 54 and interposing the tab 56 between the end portions 38 at the back end of the latch arms 30. With the tab 56 in this position, the end portions 38 are prevented from moving further towards each other, thereby preventing the latching noses 40 from opening if the oven door 122 were pulled in an opening direction. Additionally, rotation of the pawl 54 has brought the cam surface 60 on the pawl 54 against the arm 120 of the microswitch 118, which may actuate an indicator light (not shown) showing that the oven is in the self-cleaning mode. The closed door sensor assembly 10 continues to be actuated.

Figure 9:
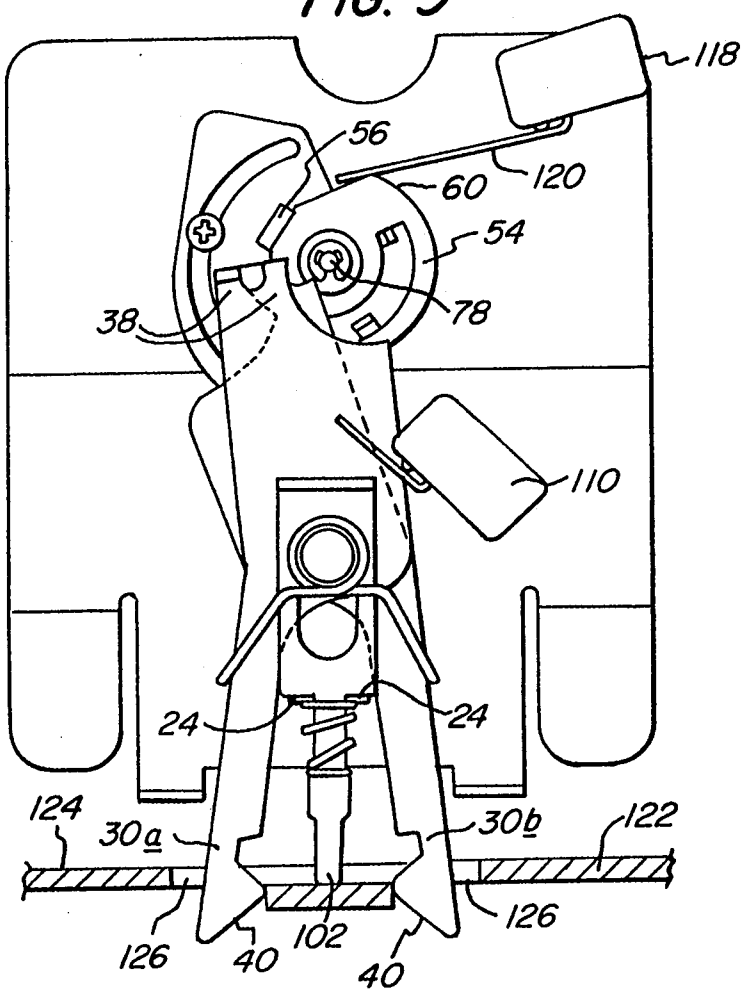
FIG. 9 is a similar view with the thermal locking mechanism having rotated to again move the locking tab into its position spaced from the latch arms and with the latch arms being cammed apart to exit from the inner face of the oven door as the oven door is opened.

Referring next to FIG. 9, the oven has cooled below a preset temperature, causing the bimetallic coil 70 to rotate the shaft 78, thereby locating the tab 56 on the pawl 54 outwardly of the end portions 38 of the latch arms 30. An opening motion has moved the oven door 122 into a partially open position by camming apart the latching noses 40 since the end portions 38 of the latch arms 30 are now able to move towards each other. The partial opening of the oven door 122 has allowed the sensing plunger 102 to move towards its forward biased position, thereby deactivating the microswitch 110, and rotation of the pawl 54 has spaced the cam surface 60 from the arm 120, thereby deactivating microswitch 118.

Figure 10:
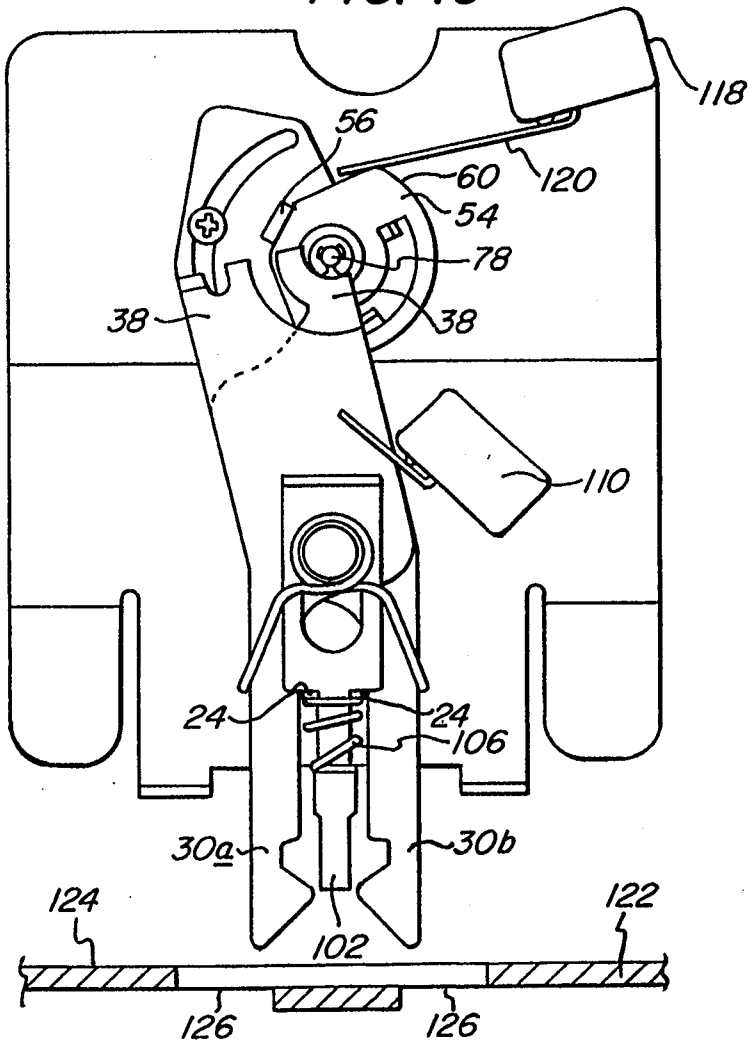
FIG. 10 is a similar view with all operating elements again in the disengaged position.

Referring last to FIG. 10, the oven door 122 has been further opened, withdrawing the latching noses 40 from the horizontally spaced openings 126 and allowing them to be biased against the stop element 24. All other parts are configured as in FIG. 9. As can be seen from a comparison of FIG. 10 with FIG. 5, the parts are positioned identically, thereby completing a cycle.

Thus, it can be seen from the foregoing detailed specification and the attached drawings that the oven safety door latch of the present invention provides a positive mechanical lock without a handle, and the two latching noses 40 provide secure latching of the oven door 122, when the action of the pawl tab 56 on the latching arms 30 provides a lock for the latching mechanism. The parts may be readily and relatively economically fabricated and assembled.

Having thus described the invention, what is claimed is:

1. An oven safety door latch for use with an oven door having a pair of horizontally spaced openings on its inner face, comprising:

(a) a base;

(b) a pair of elongated latch arms pivotably connected to each other and to said base at a point intermediate their length, one end of said arms projecting beyond said base, said arms having end portions at said one end with opposed latching noses;

(c) a pawl rotatably mounted on said base adjacent the other end of said arms, and having blocking means thereon engageable with the end portions at said other end of said arms;

(d) biasing means to bias said one end of said latch arms and thereby said noses towards each other;

(e) limiting means on said base to limit movement of said noses towards each other; and (f) a thermally responsive element supported by said base and operatively connected to said pawl to rotate said pawl between a first position in which said blocking means is spaced from said arms, and a second position in which said blocking means is engaged with said end portions of said arms to limit movement thereof and thereby to limit movement of said noses away from each other, whereby closing movement of the associated oven door allows said noses to be cammed apart by the inner face of the associated door and to pass through the horizontally spaced openings in the associated door, said biasing means thereafter biasing said noses towards each other to lock behind the inner face of the associated door adjacent the openings therein, subsequent heating of said thermally responsive element above a preset temperature causing said pawl to rotate from said first position to said second position to block movement of said arms and camming apart of said noses by movement of the door in an opening direction, subsequent cooling of said thermally responsive element below a preset temperature causing said pawl to rotate from said second position to said first position to allow movement of said arms and the camming apart of said noses upon opening movement of the associated oven door.

2. The oven safety door latch of claim 1 wherein said blocking means on said pawl is a tab interposable between said end portions at said other end of said arms to limit movement thereof towards each other and thereby to limit movement of said noses away from each other.

3. The oven safety door latch of claim 2 wherein said biasing means also biases said end portions at said other end of said arms away from each other as it biases said one end of said latch arms and thereby said noses towards each other.

4. The oven safety door latch of claim 1 wherein the biasing means is a spring engaged with said latch arms intermediate said latching noses and said point of pivotable connection.

5. The oven safety door latch of claim 4 wherein said spring is a tension spring having its ends engaged with said arms.

6. The oven safety door latch of claim 1 wherein the limiting means is a stop element on the base disposed between the pivot point and said end portions at said one end of said arms.

7. The oven safety door latch of claim 1 wherein said base seats a pivot pin at said point of pivotal connection, and each of said arms has an aperture pivotally seating said pin.

8. The oven safety door latch of claim 7 wherein said arms have overlying horizontally disposed ears and said apertures are disposed therein.

9. The oven safety door latch of claim 1 wherein said latch includes temperature setting elements and said preset temperatures are set by said temperature setting elements engaging said pawl to limit its rotation.

10. The oven safety door latch of claim 9 wherein said temperature setting elements are adjustably mounted on said base.

11. The oven safety door latch of claim 1 wherein said thermally responsive element is a bimetallic coil.

12. An oven safety door latch for use with an oven door having a pair of horizontally spaced openings on its inner face, comprising:

(a) a base;

(b) a pair of elongated latch arms pivotably connected to each other and to said base at a point intermediate their length, one end of said arms projecting beyond said base, said arms having end portions at said one end with opposed latching noses;

(c) a pawl rotatably mounted on said base adjacent the other end of said arms, and having a tab thereon interposable between the end portions at said other end of said arms;

(d) biasing means to bias said one end of said latch arms and thereby said noses towards each other and said end portions at said other end of said arms away from each other;

(e) limiting means on said base to limit movement of said noses towards each other; and (f) a thermally responsive element supported by said base and operatively connected to said pawl to rotate said pawl between a first position in which said tab is spaced outwardly of said arms, and a second position in which said tab is interposed between said end portions to limit movement thereof towards each other and thereby to limit movement of said noses away from each other, whereby closing movement of the associated oven door allows said noses to be cammed apart by the inner face of the associated door and to pass through the horizontally spaced openings in the associated door, said biasing means thereafter biasing said noses towards each other to lock behind the inner face of the associated door adjacent the openings therein, subsequent heating of said thermally responsive element above a preset temperature causing said pawl to rotate from said first position to said second position to block movement of said arms and camming apart of said noses by movement of the door in an opening direction, subsequent cooling of said thermally responsive element below a preset temperature causing said pawl to rotate from said second position to said first position to allow movement of said arms and the camming apart of said noses upon opening movement of the associated oven door.

13. The oven safety door latch of claim 12 wherein the biasing means is a spring engaged with said latch arms intermediate said latching noses and said point of pivotable connection.

14. The oven safety door latch of claim 12 wherein the limiting means is a stop element on the base disposed between the pivot point and said end portions at said one end of said arms.

15. The oven safety door latch of claim 12 wherein said base seats a pivot pin at said point of pivotal connection, and each of said arms has an aperture pivotally seating said pin.

16. The oven safety door latch of claim 12 wherein said latch includes temperature setting elements and said preset temperatures are set by said temperature setting elements engaging said pawl to limit its rotation.

17. The oven safety door latch of claim 12 wherein said thermally responsive element is a bimetallic coil.

* * * * *